US009352804B2

(12) United States Patent
Todd

(10) Patent No.: US 9,352,804 B2
(45) Date of Patent: May 31, 2016

(54) NAUTICAL RAILING

(71) Applicant: Jeremy Todd, Gonzales, LA (US)

(72) Inventor: Jeremy Todd, Gonzales, LA (US)

( * ) Notice: Subject to any disclaimer, the term of this patent is extended or adjusted under 35 U.S.C. 154(b) by 0 days.

(21) Appl. No.: 14/510,291

(22) Filed: Oct. 9, 2014

(65) Prior Publication Data

US 2016/0101829 A1 Apr. 14, 2016

(51) Int. Cl.
*B63B 17/04* (2006.01)
*B63B 21/04* (2006.01)

(52) U.S. Cl.
CPC ..... *B63B 17/04* (2013.01); *B63B 21/045* (2013.01)

(58) Field of Classification Search
CPC ..... B63B 17/00; B63B 17/02; B63B 17/04; B63B 21/045; B63B 45/00; B63B 45/02; B63B 21/04
USPC ..... 114/218, 364
See application file for complete search history.

(56) References Cited

U.S. PATENT DOCUMENTS

| | | | | |
|---|---|---|---|---|
| 820,974 | A | 5/1906 | Hilpert | |
| 1,291,341 | A * | 1/1919 | Young | 114/218 |
| 2,315,516 | A | 4/1943 | Gray | |
| 3,193,228 | A * | 7/1965 | Chion | 114/364 |
| 5,243,928 | A | 9/1993 | Brenaman | |
| 6,155,191 | A * | 12/2000 | Weaver | 114/218 |
| 6,279,880 | B1 | 8/2001 | Hawks, Jr. | |
| 7,093,550 | B2 | 8/2006 | Williamson | |
| 7,475,868 | B1 | 1/2009 | Gibbs | |
| 7,896,132 | B2 | 3/2011 | O'Gorman | |
| 8,544,401 | B2 * | 10/2013 | Arote | 114/218 |
| 2011/0094828 | A1 | 4/2011 | Duvekot et al. | |
| 2013/0087087 | A1 | 4/2013 | Werbel | |

OTHER PUBLICATIONS

Webpage: Fall Protection, Construction Safety and Health Outreach Program produced by the U.S. Department of Labor OSHA Office of Training and Education and dated May 1996; https://www.osha.gov/doc/outreachtraining/htmlfiles/subpartm.html captured Sep. 11, 2014.

Feb. 12, 2016 International Search Report and Written Opinion for PCT/US2015/054840.

* cited by examiner

*Primary Examiner* — Lars A Olson
(74) *Attorney, Agent, or Firm* — John B. Edel; Edel Patents LLC

(57) ABSTRACT

Fall protection structures are disclosed relating to nautical vessels that include a nautical vessel, a precipice, a first and a second kevel adjacent to the precipice, a first post structure connected to the first kevel, a second post structure connected to the second kevel, a top railing connecting the first post structure to the second post structure, and a middle railing connecting the first post structure to the second post structure such that the top railing and the middle railing limit access to the precipice.

10 Claims, 3 Drawing Sheets

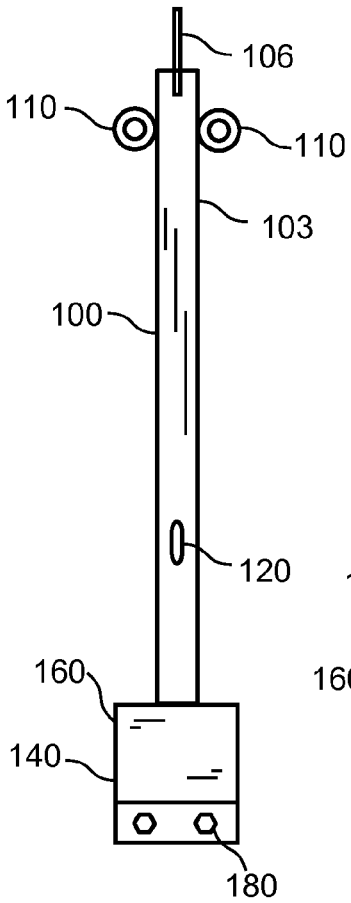
Fig. 1
Fig. 2
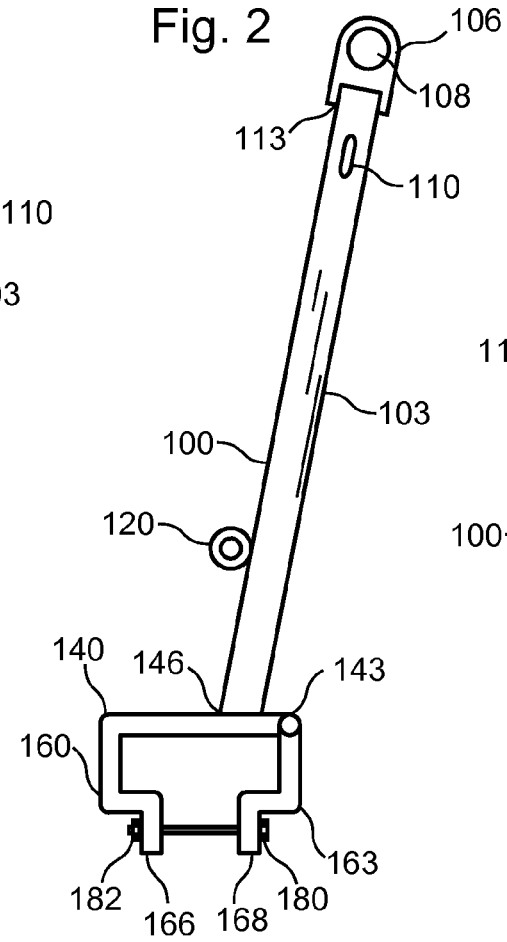
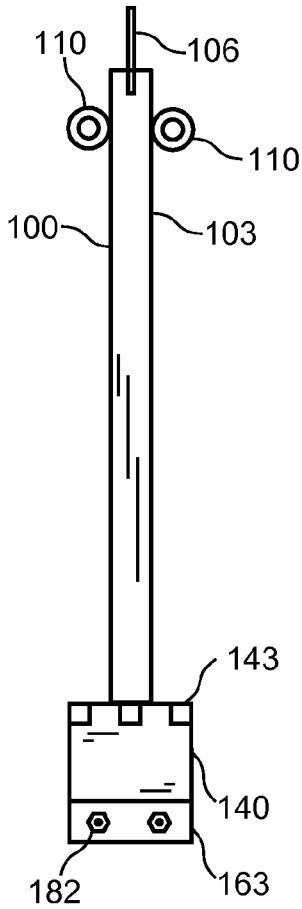
Fig. 3

NAUTICAL RAILING

Railings described herein may be used in fall protection. Certain railings disclosed herein may provide an easily installed railing system for use on nautical vessels such as barges.

FIG. 1 shows a front view of a post assembly.

FIG. 2 shows a side view of a post assembly.

FIG. 3 shows a rear view of a post assembly.

DETAILED DESCRIPTION

EXAMPLE 1

Figure 4:
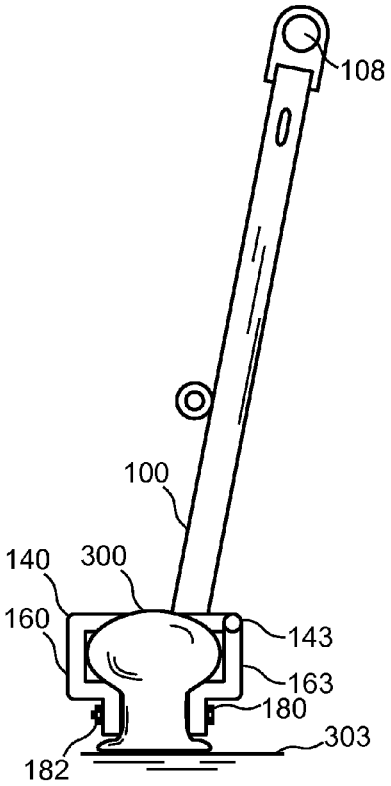
FIG. 4 shows a side view of a post assembly attached to a kevel.

Referring now to FIG. 1, FIG. 2, and FIG. 3 of the drawings, Post assembly 100 may for example comprise Rail post 103, Primary top rail eyelet 106, Primary top rail eyelet opening 108, Secondary top rail eyelets 110, Middle rail eyelet 120, and Kevel clasp 140. Kevel clasp 140 may for example comprise Kevel clasp hinge 143, Post clasp connection point 146, Clasp base 160, Clasp hinge arm 163, Clasp base lower extent 166, Clasp hinge arm lower extent 168, Bolts 180, and Nuts 182. The connection between Rail post 103 and Kevel clasp 140 may be a welded connection and Rail post 103 may extend either vertically from Kevel clasp 140 or Rail post 103 may extend from Kevel clasp 140 at an angle which deviates from vertical as shown in FIG. 2. Kevel clasp hinge 143 serves to allow Kevel clasp 140 to open in such a way that Kevel clasp 140 may grasp a kevel (not shown). Bolts 180 and Nuts 182 act to securely fastened Kevel clasp 140 around the center of a kevel (not shown). Middle rail eyelet 120 may be welded to Rail post 103 such that it may securely hold wire, rope, chain or other tension bearing flexible material. Primary top rail eyelet 106 may be welded to Rail post 103 such that Primary top rail eyelet opening 108 may securely hold wire, rope, chain or other tension bearing flexible material. Similarly, Secondary top rail eyelets 110 may be welded to Rail post 103 such that it may securely hold wire, rope, chain or other tension bearing flexible material. Primary top rail eyelet 106 or Primary top rail eyelet opening 108 may be selected based on the configuration of other posts and the intended path of associated railings. Clasp base lower extent 166 and Clasp hinge arm lower extent 168 may be situated such that they separated from Deck 303 by at least 1 inch. Clasp base lower extent 166 and Clasp hinge arm lower extent 168 may be situated such that they separated from Deck 303 by approximately 2 inches.

Figure 5:
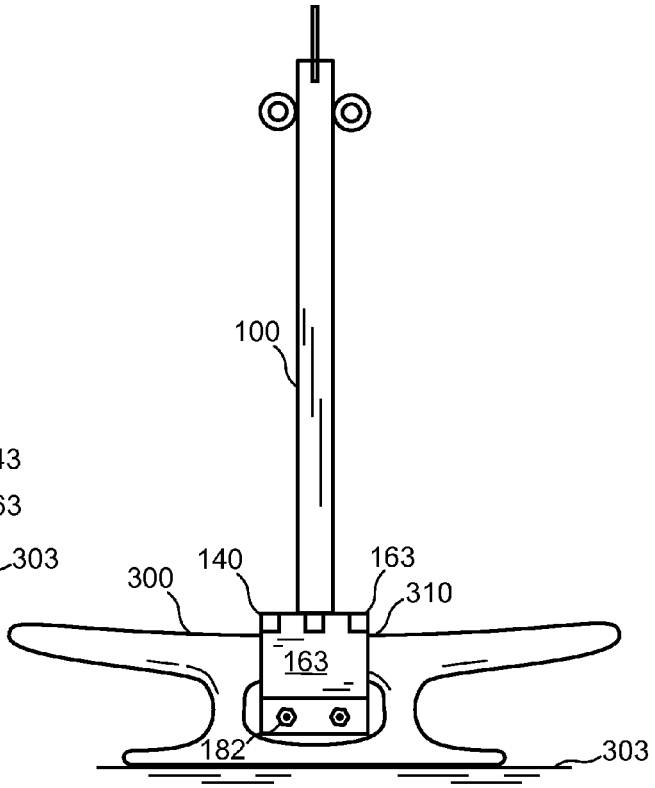
FIG. 5 shows a rear view of a post assembly attached to a kevel.

Referring now to FIG. 4 and FIG. 5 of the drawings, Post assembly 100 may be situated on and clamped to Kevel 300 by rotating Clasp hinge arm 163 around Kevel clasp hinge 143 such that Kevel clasp 140 surrounds the upper portion of Kevel 300 with Clasp base 160 and Clasp hinge arm 163 enclosing the upper central portion of Kevel 300. In such a configuration Nuts 182 may be tightened on Bolts 180 to draw Kevel clasp 140 inward securely locking Post assembly 100 into place and into a fixed position on Kevel 300. After such tightening, Post assembly 100 and Primary top rail eyelet opening 108 would be in a fixed position relative to Deck 303. In that configuration, Kevel top surface 310 would bear the majority of the weight of Post assembly 100 and support downward forces applied through Post assembly 100. Rail post 103 ends at Kevel clasp 140 at a position adjacent to Kevel top surface 310. Kevel top surface 310 may be at least 3 inches above Deck 303 and in a related embodiment, Kevel top surface 310 may be at least 5 inches above Deck 303.

Figure 6:
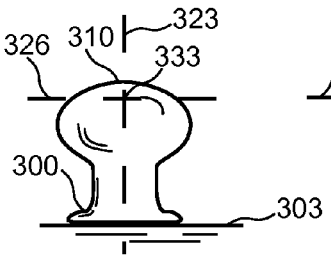
FIG. 6 shows a kevel.
Figure 7:
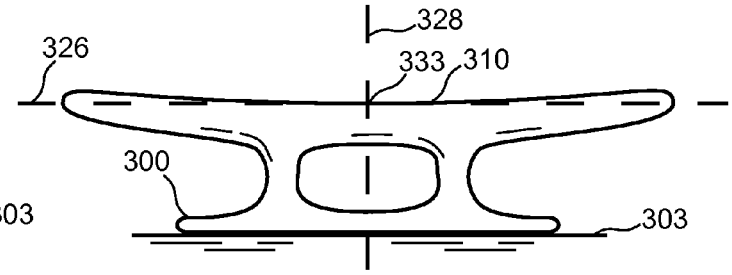
FIG. 7 shows a kevel.

Referring now to FIG. 6 and FIG. 7 of the drawings, Kevel 300 is situated on Deck 303 such that Kevel top center point 333 is situated at the convergence of Kevel longitudinal axis 323, Kevel top base level 326, and Kevel cross axis 328. Kevel longitudinal axis 323 divides Kevel 300 evenly along the length of Kevel 300. Kevel top base level 326 represents the height of Kevel 300 at the center of Kevel 300. Kevel cross axis 328 divides Kevel 300 evenly along the width of Kevel 300. Each of Kevel longitudinal axis 323, Kevel top base level 326, and Kevel cross axis 328 are perpendicular to one another. As may be seen through the combination of FIG. 4, FIG. 5, FIG. 6, and FIG. 7, the weight of Post assembly 100 is predominantly supported by Kevel 300 through the contact between Post assembly 100 and Kevel 300 at Kevel top base level 326. Kevel top center point 333 may be situated at a height of about 8.5 inches above Deck 303.

The weight of Post assembly 100 may, for example, be predominantly supported by loadbearing contact with Kevel 300 at a height of greater than 2 inches above deck level. In a related example, the weight of Post assembly 100 may, for example, be predominantly supported by loadbearing contact with Kevel 300 at a height of greater than 4 inches above deck level. In a further related example, the weight of Post assembly 100 may, for example, be predominantly supported by loadbearing contact with Kevel 300 at a height of greater than 6 inches above deck level. In a further related example, the weight of Post assembly 100 may, for example, be predominantly supported by loadbearing contact with Kevel 300 at a height of greater than 7 inches above deck level.

In several embodiments, Deck 303 and Post assembly 100 are neither joined directly nor in direct contact with one another. In related but separate embodiments, the distance between Deck 303 and Post assembly 100 may be greater than 1 inch, greater than 2 inches or greater than 3 inches. As shown in FIG. 2 and FIG. 4, Rail post 103 may be arranged at an angle from vertical. Various embodiments may have one or more of the following features: a Rail post 103 which departs from a vertical orientation by an angle of greater than 5°, a Rail post 103 which departs from a vertical orientation by an angle of approximately 15°, a Rail post 103 which departs from a vertical orientation by an angle of less than 20°, and a Rail post 103 which departs from a vertical orientation by an angle of less than 30°. Rail post 103 may for example depart from a vertical orientation by an angle of 15°. In an alternate embodiment, Rail post 103 may have a vertical orientation. Rail post 103 may depart from vertical such that Rail post 103 leans from Kevel 300 toward a precipice which may be the edge of a nautical vessel.

Kevel 300 and Post assembly 100 may be positioned such that, the center of gravity of Kevel 300 may be located above a first deck location and the center of gravity of Post assembly 100 may be located above a second deck location such that the first deck location and the second deck location are within 2 feet of one another. Similarly, the first deck location may be within one foot of the second deck location.

Figure 8:
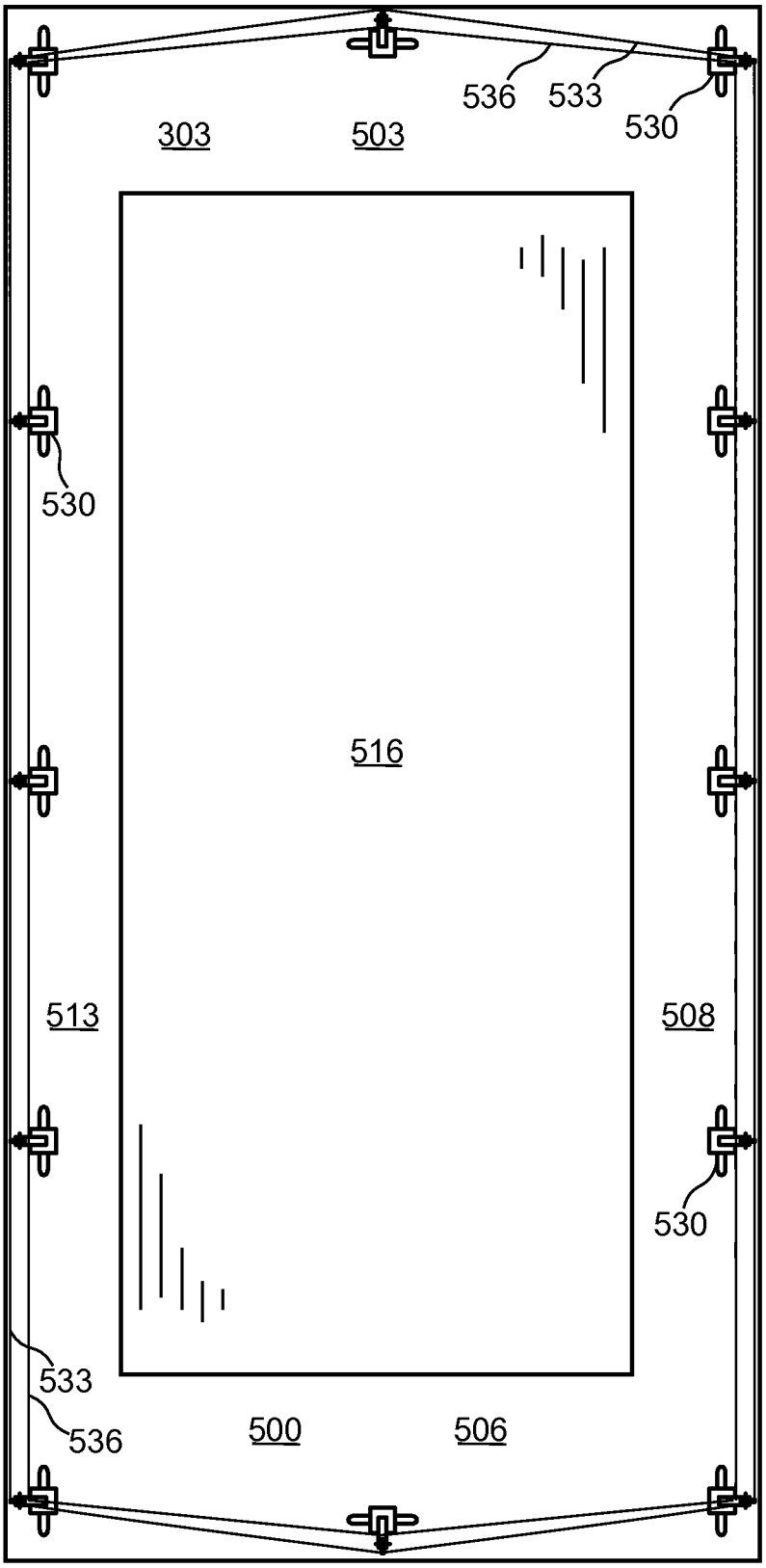
FIG. 8 shows a top view of a barge.

Referring now to FIG. 8 of the drawings, Barge 500 may incorporate Post assemblies 100 (not individually shown) on Kevels 300 (not individually shown). Post assembly on a kevel 530 as shown in FIG. 8 includes a Post assembly 100 situated on a Kevel 300. As shown in FIG. 8 a Post assembly on a kevel 530 is shown at each of the locations where a Kevel 300 is located on Barge 500. Barge 500 may be set up in this configuration or a large number of additional configurations depending on the fall protection needs for either the general situation of Barge 500 or the particular situation of Barge 500 at a point in time. Supplemental post assemblies that are not attached to kevels may be added to the railing system. The number of Post assemblies on kevels 530 on a Barge 500 would in most circumstances be at least two and not greater than the number of Kevels 300 on Barge 500. However, in circumstances in which more than one Barge 500 is adjacent to one another an individual Post assembly on a kevel 530 may be used on one of the Barges 500. Barge 500 has a Deck 303 which is the primary walking surface for Barge 500. Barge 500 further has a Bow 503, a Stern 506, a Starboard side 508, a Port Side 513, and a Cargo Area 516. One or more of Top rail wire rope 533 and one or more of Middle rail wire rope 536 may be run through the eyelet openings of Post assemblies 100 (not individually shown) which are part of Post assemblies on kevels 530. Top rail wire rope 533 and Middle rail wire rope 536 may be drawn to be taut such that they positioned to serve as a fall protection top rail and middle rail. Referring back to FIG. 1, FIG. 2, FIG. 3, FIG. 4, and FIG. 5 of the drawings, Primary top rail eyelet 106 and Secondary top rail eyelets 110 may be used to guide, secure and hold taut Top rail wire rope 533 with the selection between Primary top rail eyelet 106 and Secondary top rail eyelets 110 depending on the position of Post assembly on a kevel 530 and the desired path of the Top rail wire rope 533. Middle rail eyelet 120 may be used to guide, secure and hold taut Middle rail wire rope 536. Together, Top rail wire rope 533, Middle rail wire rope 536, and Post assemblies on kevels 530 form a fall protection barrier in the form of posts and rails to protect workers and any other occupants on Deck 303 from the risk of falling off of Deck 303.

Top rail wire rope 533 and Middle rail wire rope 536 are examples of the materials that could be used between Post assemblies 100. In alternate embodiments, various flexible materials with significant tensile strength may be used in place of the wire rope. Examples of replacement materials might be rope such as hemp rope, chains and various forms of wires or cables. In certain other embodiments, rigid elements could be used to span the Post assemblies 100 such as lumber or elongate rigid metal elements. Further, combinations of rigid and non-rigid materials may be used. Because Kevels 300 would generally be considered a part of Barge 500 the connection between Post assembly 100 and Barge 500 may be characterized as a weldless connection.

Together, Top rail wire rope 533, Middle rail wire rope 536, and Post assemblies on kevels 530 may be configured to create a fall protection system that has the following features. Top rail wire rope 533 and Middle rail wire rope 536 may be constructed of wire rope that is at least one-quarter inch in diameter. Top rail wire rope 533, may be flagged at intervals of 6 feet or less with high-visibility material. Further, manila, plastic, or synthetic rope may be used in place of Top rail wire rope 533 or Middle rail wire rope 536. The top edge height of Top rail wire rope 533, or any equivalent railing may be 42 inches plus or minus 3 inches above the walking, working, or deck level. Middle rail wire rope 536 may be installed at a height midway between the top edge of the guardrail system and the walking, working, or deck level. The railing system may be constructed such that there are no openings in the railing system more than 19 inches. The railing system may be capable of withstanding a force of at least 200 pounds applied within 2 inches of the top edge in any outward or downward direction. Further, when the 200 pound test is applied in a downward direction, Top rail wire rope 533 may be configured such that it does not deflect to a height less than 39 inches above the walking, working, or deck level. Middle rail wire rope 536 may be used in conjunction with or replaced by screens, mesh, intermediate vertical members, solid panels, and equivalent structural members and in certain embodiments those structures are capable of withstanding a force of at least 150 pounds applied in any downward or outward direction at any point along the Middle rail wire rope 536 or equivalent member.

The point where Post assembly 100 contacts Top rail wire rope 533 may be less than 42 inches from Kevel top center point 333. Further, The point where Post assembly 100 contacts Middle rail wire rope 536 may be less than 19 inches from Kevel top center point 333. Top rail wire rope 533 and Middle rail wire rope 536 may be located within one foot of Kevel longitudinal axis 323 and may alternatively be located within 2 feet of Kevel longitudinal axis 323.

Any number of Kevels 300 may be utilized in conjunction with Post assemblies 100 and ropes, wire ropes or other materials to create either fully enclosed areas or partially enclosed areas. In many embodiments, Post assemblies on kevels 530 are used to barricade a particular area from a precipice and the barricade terminates at one or more Kevels 300.

Post assembly 100 may be constructed from one or more of iron, WCB iron, steel, aluminum, stainless steel, and various alloys suitable for the marine environment in which Post assembly 100 is to be utilized. Further, Post assembly 100 may be galvanized, powder coated, painted or otherwise treated to prolong the useful life of Post assembly 100.

EXAMPLE 2

In one embodiment, a barge having kevels and one or more precipices that pose a significant fall hazard is outfitted with post assemblies as described in the preceding example such that the post assemblies are positioned on kevels and adjacent to the one or more precipices presenting the fall hazard. After the post assemblies are secured into place on the kevels wire rope or other suitable barricading materials are secured into place between the post assemblies such that a fall protection barricade is located along and adjacent to the one or more precipices. The resulting barricade may be consistent with the configurations depicted in one or more of FIGS. 1, 2, 3, 4, 5, and 8 or may take on any number of suitable variations.

As that term is used herein "flexible tension device" includes for example chains, rope, wire rope and other similar items that can be similarly tensioned and are capable of being looped.

Railing structures described herein may, for example, comprise a deck; a first kevel located on the deck, the first kevel having a first kevel center of gravity; a first deck location on the deck directly below the first kevel center of gravity; a first post structure located above the deck having a first post center of gravity; a second deck location on the deck directly below the first post center of gravity; a weldless mechanical connection joining the first kevel to the first post structure; and a set of rails extending horizontally from the first post structure; wherein the first deck location is within two feet of the second deck location. In a related example, the set of rails may comprise a wire rope. In a further related example, the set of rails may comprise a flexible tension device. In a further related example, the first kevel has a first kevel top and the first kevel top may bear the majority of downward force exerted by the first post structure. In a still further related example, the first post structure is not directly connected to the deck.

Fall protection structures described herein may, for example, comprise a nautical vessel; a precipice on the nautical vessel; a first kevel adjacent to the precipice; a second kevel adjacent to the precipice; a first post structure connected to the first kevel; a second post structure connected to the second kevel; a top railing connecting the first post structure to the second post structure; and a middle railing connecting the first post structure to the second post structure; wherein the top railing and the middle railing limit access to the precipice. In a related example, the top railing and the middle railing may be located between and above the first kevel and the second kevel. In a further related example, the nautical vessel may be a barge. In a further related example, the first post structure may bolt onto the first kevel. In a still further related example, the top railing and the middle railing may enclose a portion of the nautical vessel. In a still further related example the first post structure comprises a first mechanical clamp and the second post structure comprises a second mechanical clamp.

The above-described embodiments have a number of independently useful individual features that have particular utility when used in combination with one another including combinations of features from embodiments described separately. There are, of course, other alternate embodiments which are obvious from the foregoing descriptions of the invention, which are intended to be included within the scope of the invention, as defined by the following claims.

I claim:

1. A railing structure comprising:

a. a deck;

b. a first kevel located on the deck, the first kevel having a first kevel center of gravity;

c. a first deck location on the deck directly below the first kevel center of gravity;

d. a first post structure located above the deck having a first post center of gravity;

e. a second deck location on the deck directly below the first post center of gravity;

f. a weldless mechanical connection joining the first kevel to the first post structure; and g. a set of rails extending horizontally from the first post structure;

h. wherein the first deck location is within two feet of the second deck location; and i. wherein the set of rails comprises a flexible tension device.

2. The railing structure of claim 1 wherein the flexible tension device comprises a wire rope.

3. The railing structure of claim 1 wherein the first kevel has a first kevel top and the first kevel top bears the majority of a downward force exerted by the first post structure.

4. The railing structure of claim 1 wherein the first post structure is not directly connected to the deck.

5. A fall protection structure comprising:

a. a nautical vessel;

b. a precipice on the nautical vessel;

c. a first kevel adjacent to the precipice;

d. a second kevel adjacent to the precipice;

e. a first post structure connected to the first kevel;

f. a second post structure connected to the second kevel;

g. a top railing connecting the first post structure to the second post structure; and h. a middle railing connecting the first post structure to the second post structure;

i. wherein the top railing and the middle railing limit access to the precipice.

6. The fall protection structure of claim 5 wherein the top railing and the middle railing are located between and above the first kevel and the second kevel.

7. The fall protection structure of claim 5 wherein the nautical vessel is a barge.

8. The fall protection structure of claim 5 wherein the first post structure bolts onto the first kevel.

9. The fall protection structure of claim 5 wherein the top railing and the middle railing enclose a portion of the nautical vessel.

10. The fall protection structure of claim 5 wherein the first post structure comprises a first mechanical clamp and the second post structure comprises a second mechanical clamp.

* * * * *